US006698761B1

(12) United States Patent
Clague

(10) Patent No.: US 6,698,761 B1
(45) Date of Patent: Mar. 2, 2004

(54) MAGNET MOVEMENT GAMING DEVICE

(76) Inventor: Marty Clague, 11660 W. Trumble Loup, Bellevue, NE (US) 68123

( * ) Notice: Subject to any disclaimer, the term of this patent is extended or adjusted under 35 U.S.C. 154(b) by 0 days.

(21) Appl. No.: 10/251,321

(22) Filed: Sep. 20, 2002

(51) Int. Cl.[7] ..... A63F 9/34

(52) U.S. Cl. ..... 273/443; 273/112; 273/441; 273/456

(58) Field of Search ..... 273/443, 448, 273/112, 108, 440, 441, 459, 456; 446/129, 132

(56) References Cited

U.S. PATENT DOCUMENTS

| | | | | | |
|---|---|---|---|---|---|
| 2,746,206 | A | * | 5/1956 | Hammond, Jr. | 40/426 |
| 2,956,807 | A | * | 10/1960 | Luchinsinger | 273/443 |
| 3,114,547 | A | * | 12/1963 | Joslyn | 273/443 |
| 3,116,929 | A | * | 1/1964 | Kernodle | 273/153 R |
| 3,466,796 | A | * | 9/1969 | Greenblatt | 446/132 |
| 3,964,746 | A | * | 6/1976 | MacMurdo | 273/108 |
| 4,004,808 | A | * | 1/1977 | Gerber | 273/108 |
| 4,062,543 | A | * | 12/1977 | Loeffler | 273/110 |
| 4,160,548 | A | * | 7/1979 | Breslow et al. | 273/443 |
| 4,192,508 | A | * | 3/1980 | Livick | 273/118 A |
| 4,236,713 | A | * | 12/1980 | Moreno | 273/443 |
| 4,667,960 | A | * | 5/1987 | Stefanini | 273/153 R |

FOREIGN PATENT DOCUMENTS

| | | | | |
|---|---|---|---|---|
| DE | 3201438 | * | 7/1983 | G09F/19/02 |
| GB | 2038067 | * | 7/1980 | A63B/59/00 |

* cited by examiner

*Primary Examiner*—Raleigh W. Chiu
(74) *Attorney, Agent, or Firm*—Adam H. Jacobs

(57) ABSTRACT

A magnet movement gaming device includes a base and at least one track extending upwards from the base. A traveling magnet is movably mounted on the track and a propulsion magnet which is generally freely movable about the traveling magnet is used to propel the traveling magnet along the track upon the propulsion magnet being moved generally adjacent the traveling magnet. The traveling magnet is moved along the track via magnetic force between the propulsion magnet and traveling magnet.

10 Claims, 3 Drawing Sheets

MAGNET MOVEMENT GAMING DEVICE

BACKGROUND OF THE INVENTION

1. Technical Field

The present invention relates generally to games of skill and, more particularly, to a magnet movement gaming device which includes a base, at least one track extending upwards from the base, a traveling magnet movably mounted on the track, and a propulsion magnet freely movable about the traveling magnet, such that movement of the propulsion magnet adjacent the traveling magnet results in the traveling magnet being moved along the track.

2. Description of the Prior Art

People have long been fascinated by magnetism and the attractive and repulsive forces associated therewith. While there are numerous practical uses for the forces of magnetism, there have also been numerous uses of magnetism in connection with entertainment devices, particularly gaming devices and the like. Some of the magnetic gaming devices found in the prior art include Pasewalk, U.S. Pat. No. 5,152,528, which discloses a magnetic race car gaming device having a plurality of side-by-side tracks on which race cars having magnets are mounted. By rapidly turning a shaft, a magnet is moved underneath a car to drag the car forward on the track, thus creating the illusion of racing of the cars. Another such device is found in Rogers, Jr., U.S. Pat. No. 4,272,075, which discloses a fishing game having a plurality of target holes into which a magnetic device is extended to attempt to catch the magnetized fish residing underneath the target holes. Finally, another prior art device is found in Brotz, U.S. Pat. No. 4,012,038, which discloses a magnetic toy having one or more pivotal member rods each having a bar magnet movably mounted at the end thereof, the device operating such that when both the pivotal member bar magnet and the lower grab bar magnet have like poles in close proximity, magnetic propulsion will cause the pivotal member to revolve.

Although each of these prior art devices disclose a magnetic gaming device which involves some degree of skill in order to play the device, there is little development of hand-eye coordination in connection with the playing skill developed for the game. Many of the more popular non-magnetic games currently on the market include this element of gaming skill combined with hand-eye coordination to produce a gaming experience which is greatly enhanced. The prior art devices described above lack this element of the gaming experience in large measure and therefore there is a need for a magnetic gaming device which requires a good degree of hand-eye coordination in addition to developing certain gaming skills which permit the player of the game to complete the specified task.

Furthermore, there is a dearth of elegant yet functional games for use by players, specifically, gaming devices which not only are enjoyable to play but contain elements of artistic merit. Although some of the magnetic gaming devices of the prior art include such artistic and ornamental features, there is far more emphasis on the functionality of the gaming device than on the aesthetic appearance of the gaming device. There is therefore a need for a magnetic gaming device which incorporates not only functional gaming features but also includes elements which have artistic merit.

Therefore, an object of the present invention is to provide an improved magnetic movement gaming device.

Another object of the present invention is to provide a magnetic movement gaming device which includes a base on which a track is mounted extending upwards therefrom, a traveling magnet movably mounted on the track, and a propulsion magnet freely movable about the traveling magnet such that as the propulsion magnet is moved adjacent to the traveling magnet, magnetic force drives the traveling magnet along the track.

Another object of the present invention is to provide a magnetic movement gaming device which includes one or more tracks, the tracks being constructed of generally cylindrical wire formed into curvilinear designs extending upwards from the base of the device therefore incorporating artistic elements as well as functional elements.

Another object of the present invention is to provide a wand or the like on which the propulsion magnet is mounted to permit the player of the game to freely move the propulsion magnet about the traveling magnet, thereby enhancing game play.

Another object of the present invention is to provide a magnet movement gaming device which incorporates elements of both hand-eye coordination and specific gaming skill to produce an enjoyable and challenging gaming experience.

Finally, an object of the present invention is to provide a magnet movement gaming device which is relatively simple and inexpensive to construct and is safe, efficient, and enjoyable in use.

SUMMARY OF THE INVENTION

The present invention provides a magnet movement gaming device which includes a base and at least one track extending upwards from the base, preferably in a curvilinear fashion incorporating a series of loops, whirls, and other such whimsical and challenging shapes formed in the track. A traveling magnet is movably mounted on the track and a propulsion magnet which is generally freely movable about the traveling magnet is also provided. The propulsion magnet is operative to propel the traveling magnet along the track upon the propulsion magnet being moved generally adjacent the traveling magnet, the traveling magnet being moved via the magnetic force between the propulsion magnet and the traveling magnet. The propulsive force may be caused by either repulsion between like poles of the traveling magnet and propulsion magnet or by the attractive magnetic force between opposite poles of the traveling magnet and propulsion magnet, depending upon the nature of the game being played.

The magnet moving gaming device of the present invention thus provides a substantial improvement over those devices found in the prior art. For example, because the base and track may be constructed of many different materials, the artistic and aesthetic possibilities in the formation of the unit are virtually limitless, so long as the functional features of the gaming device are maintained. Furthermore, due to the curving and looping nature of the track, the difficulty and enjoyment of the gaming device is increased and, as virtually an unlimited number of different track designs may be used with the present invention, all players from beginner to expert will enjoy playing the present invention. Finally, the deceptively simple nature of the present invention makes the game playable by even young children, whereas more difficult versions of the magnet movement gaming device of the present invention can be designed for use by even very skilled players. It is thus seen that the magnet movement gaming device of the present invention is superior to those devices found in the prior art.

DESCRIPTION OF THE PREFERRED EMBODIMENT

Figure 1:
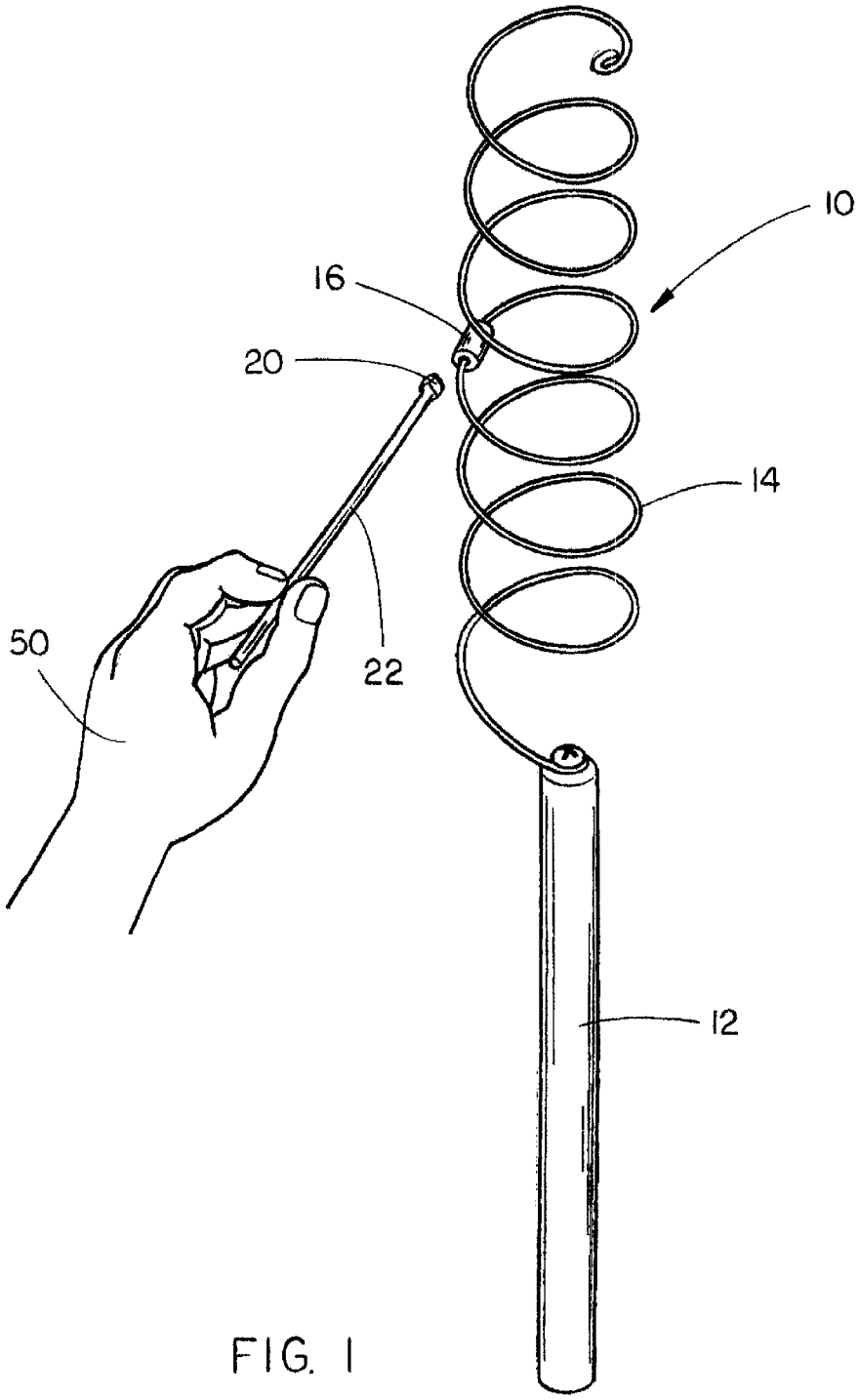
FIG. 1 is a perspective view of the preferred embodiment of the present invention showing a hand-held base, curvilinear track, and a traveling magnet mounted thereon.
Figure 3:
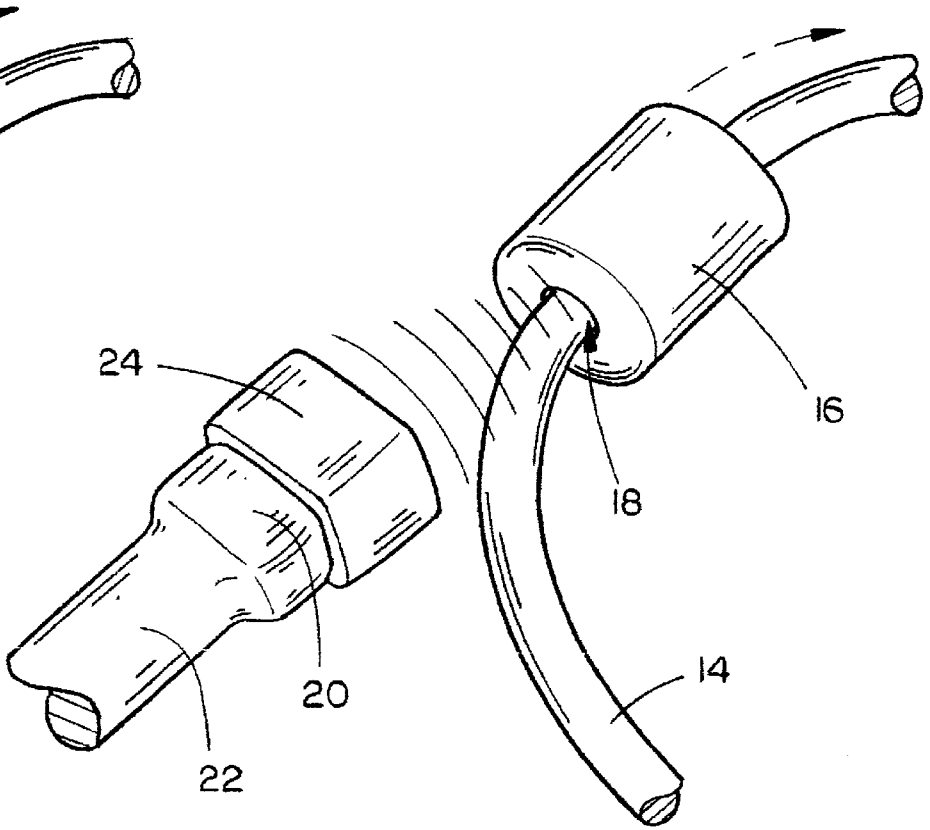
FIG. 3 is a detail perspective view of the present invention showing a stronger magnet being used as the propulsion magnet to make the present invention easier to play.
Figure 2:
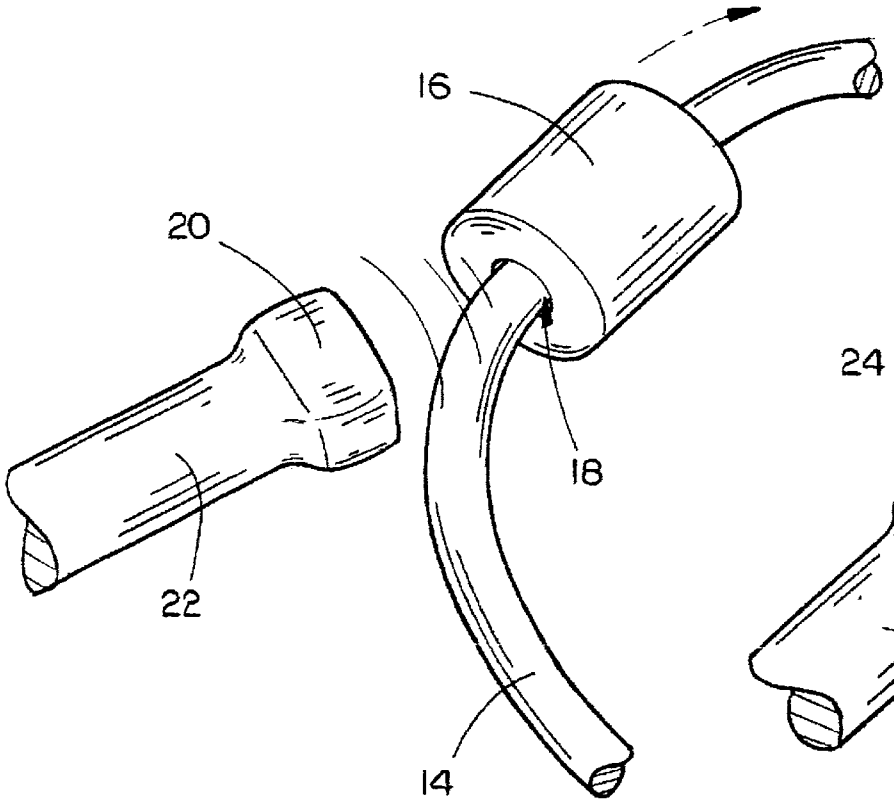
FIG. 2 is a detail perspective view of the traveling magnet movably mounted on the track with the propulsion magnet mounted on the wand being brought into close proximity therewith to propel the traveling magnet along the track.

The magnet movement gaming device 10 of the present invention is shown best in FIGS. 1–3 as including a base 12 and a track 14 mounted on and extending upwards from base 12. In the embodiment of FIG. 1, base 12 is shown as a graspable cylindrical handle designed for holding by a player of the game in one hand while the other hand is used to actually play the game of the present invention. It should be noted, however, that numerous types of bases are contemplated for use with the present invention, including tabletop stand, suction cup or clip-type bases for attaching the magnet movement gaming device 10 of the present invention to various objects.

In the preferred embodiment, track 14 would be constructed of generally cylindrical malleable wire to permit the formation of various curvilinear designs in the track 14 as shown in FIG. 1. It has been found that metal, particularly copper, is the best material for construction of the track 14 although any appropriate material with a relatively low coefficient of friction could be used with the present invention so long as the track 14 permits movement of the traveling magnet thereon. Likewise, as was discussed previously, the number of variations in track size and track shape is virtually limitless, the only limitation being the imagination of the builder of the magnet movement gaming device 10 of the present invention.

Slidably mounted on track 14 is traveling magnet 16 which, in the preferred embodiment, would be a cylindrical magnet having a center longitudinal bore 18 through which the track 14 extends, as shown best in FIGS. 2 and 3. Of course, the exact size and shape of the traveling magnet 16 is not critical to the present invention so long as game play is not degraded or destroyed, and it is expected that the traveling magnet 16 may be formed of one or more adjacent magnets secured together such that the multiple magnets move together as a single unit along the track 14. Such an arrangement of magnets may be referred to as a "shuttle" or other such descriptive name, but regardless of the exact form of the traveling magnet 16, the functional characteristics of the traveling magnet 16 or shuttle will be preferably maintained. It has been found that a generally cylindrical shaped traveling magnet 16, when combined with a relatively light weight and small size relative to the overall length of the track 14, renders the magnet movement gaming device 10 of the present invention most enjoyable to play. The center longitudinal bore 18 of traveling magnet 16 (also known as a "wire track engaging bore hole") would have a diameter greater than the outer diameter of track 14 in order to permit the traveling magnet 16 to slide along track 14 regardless of the curvilinear shapes formed in track 14.

The propulsion magnet 20 would preferably be mounted on the end of a wand 22 such that the positioning of the propulsion magnet 20 relative to traveling magnet 16 may be more accurately controlled. The wand 22 may be constructed of any appropriate material such as wood or plastic so long as the wand 22 may be easily gripped by a person 50 using the magnet movement gaming device 10 of the present invention. Of course, it should be noted that any type of support device for propulsion magnet 20 may be used with the present invention so long as the intended purpose of permitting accurate movement of the propulsion magnet 20 is maintained.

Game play of the magnet movement gaming device 10 of the present invention is performed in the following manner. The traveling magnet 16 rests on the track 14 as shown in FIG. 1. As propulsion magnet 20 is moved adjacent traveling magnet 16, the like poles of the traveling magnet 16 and propulsion magnet 20 interact such that the repulsive magnetic force therebetween forces the propulsion magnet 20 and traveling magnet 16 away from one another. As the wand 22 on which propulsion magnet 20 is mounted is being supported by the individual playing the game, thus preventing the propulsion magnet 20 from moving, the traveling magnet 16 is the magnet which moves away from the propulsion magnet 20 along the track 14, as shown best in FIG. 2. By moving the propulsion magnet 20 closer to the traveling magnet 16, the traveling magnet 16 may be forced upwards along track 14 until the top of the track 14 is reached and the game is won. Alternatively, the opposite poles of propulsion magnet 20 and traveling magnet 16 may be brought adjacent to one another and the attractive force resulting therefrom may be used to pull traveling magnet 16 along track 14 upwards towards the top of track 14. In either situation, it is the repulsive or attractive magnetic force which causes traveling magnet 16 to move along track 14, not a physical contact force as is seen in many other games of this type.

Although the above description makes the game play of the magnet movement gaming device 10 of the present invention sound relatively simple, it is anything but. It is exceedingly difficult to keep the propulsion magnet 20 and traveling magnet 16 from contacting one another due to the relatively close proximity into which the magnets must be brought to permit the magnetic force to overcome the frictional force of the traveling magnet 16 resting on track 14. In such close proximity, it is very easy for the poles of the magnets to interact in unpredictable ways, thus causing the traveling magnet 16 to move along track 14 in an unpredictable manner. Furthermore, particularly when the same magnetic poles are being used to provide a repulsive force to drive traveling magnet 16 along track 14, the opposite poles of the propulsion magnet 20 and traveling magnet 16 are also in close proximity and the attractive force between the opposite poles can easily overcome the repulsive force should the propulsion magnet 20 be moved to a point adjacent the traveling magnet 16 where the opposite poles are closer together than the like poles of the magnets. This causes the traveling magnet 16 and propulsion magnet 20 to come into contact with one another and, according to the rules of the game, the person playing the game would have to start over as they have just lost.

FIG. 3 illustrates an alternative embodiment of the magnet movement gaming device 10 of the present invention in which an additional propulsion magnet 24 has been added to propulsion magnet 20 to increase the magnetic force of the combined magnets 20 and 24. This embodiment is designed for use by beginners who are not familiar with the operation of the magnet movement gaming device 10 of the present invention in that the increased magnetic force makes movement of traveling magnet 16 a much simpler procedure as the traveling magnet 16 and propulsion magnet 20 need not come into as close contact as that required by the embodiment shown in FIG. 2. Of course, it should be noted that the magnetic strengths of the propulsion magnet 20 and traveling magnet 16 may be modified or changed to increase or decrease the difficulty of game play of the present invention, depending on the intentions of the designer and constructor of the invention.

Figure 5:
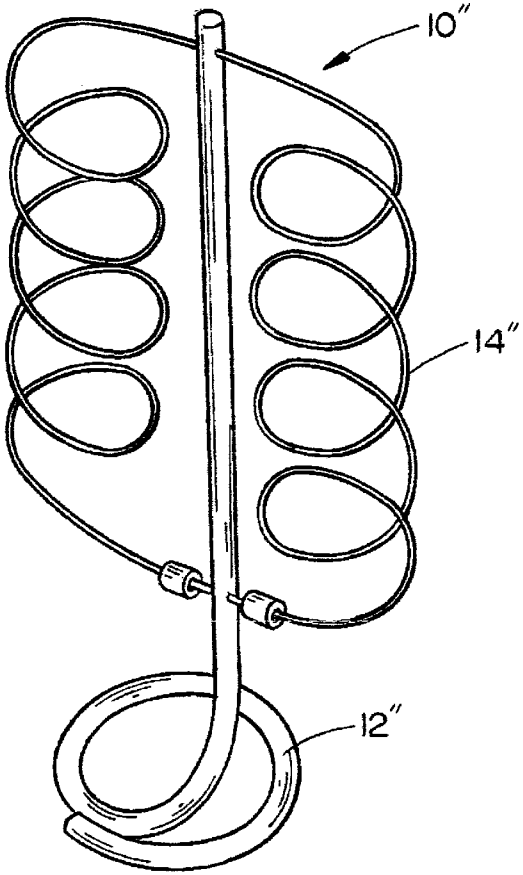
FIGS. 4 and 5 demonstrate alternative embodiments of the magnet movement gaming device of the present invention with various bases and track designs.
Figure 4:
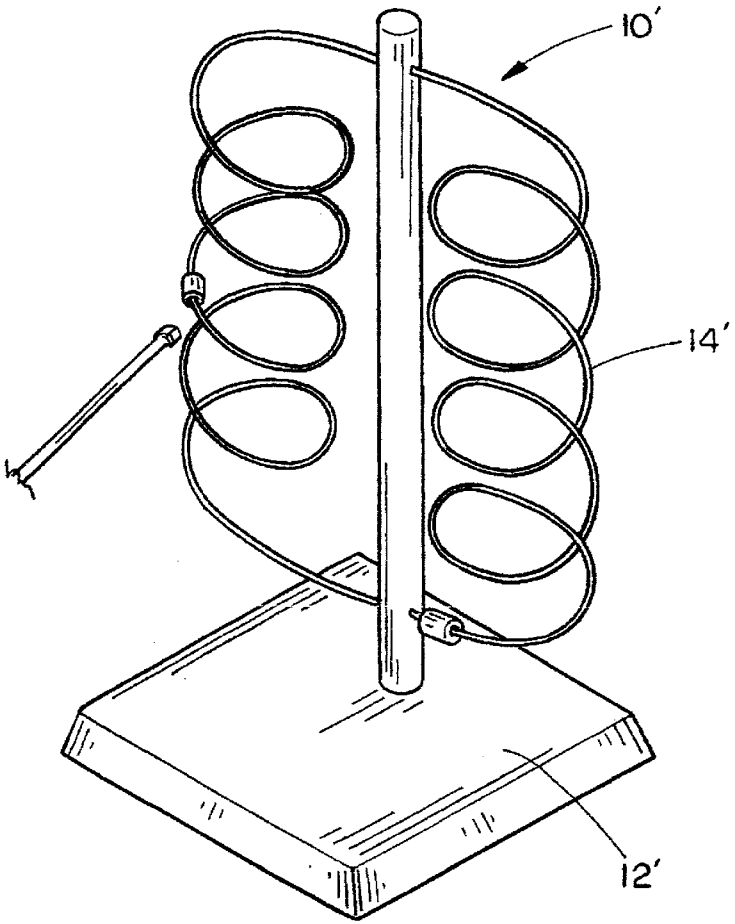

FIGS. 4 and 5 illustrate two alternative embodiments of the magnet movement gaming device 10' and 10 " of the present invention which include alternative base structures 12' and 12" and multiple tracks 14' and 14". The embodiments shown in FIGS. 4 and 5 are illustrative of the numerous variations in shape, size, and building materials which may be used with the present invention to provide various artistic and aesthetic appearances while maintaining the functionality and game play of the present invention. It is even expected that various embodiments of the present invention may be created as functional art pieces which will lend beauty to any home or office.

Finally, it is to be understood that numerous modifications, additions, and substitutions may be made to the magnet movement gaming device 10 of the present invention which fall within the intended broad scope of the appended claims. For example, the size, shape, and building materials used in connection with the present invention may be changed or modified according to the whims of the designer and user of the invention so long as the functional characteristics of the present invention are maintained. Furthermore, the relative strengths of the traveling magnet 16 and propulsion magnet 20 may be modified or changed to increase or decrease the difficulty of the game play of the present invention. Also, the shape and design of the base 12 may be modified to enhance the aesthetic appearance of the present invention. Finally, the number of tracks, shape of tracks, and design of tracks may be modified and/or changed so long as the intended functionality of the present invention is maintained.

There has therefore been shown and described a magnet movement gaming device 10 which accomplishes at least all of its intended objectives.

I claim:

1. A magnetic movement gaming device comprising:

a base;

at least one traveling magnet supporting track means mounted on and extending upwards from said base, said at least one traveling magnet supporting track means having opposite ends, at least one of said opposite ends connected to said base, said at least one traveling magnet supporting track means generally free of connection to said base except at least one of said opposite ends such that said at least one traveling magnet supporting track means is generally freely supported on said base;

a traveling magnet movably mounted on and supported by said at least one traveling magnet supporting track means;

a propulsion magnet generally freely movable about said traveling magnet; and said propulsion magnet operative to propel said traveling magnet along said at least one traveling magnet supporting track means upon said propulsion magnet being moved generally adjacent said traveling magnet, said traveling magnet being moved along said at least one traveling magnet supporting track means via magnetic force between said propulsion magnet and said traveling magnet.

2. The magnetic movement gaming device of claim 1 wherein said base comprises a tabletop stand.

3. The magnetic movement gaming device of claim 1 wherein said base comprises a graspable cylindrical handle adapted for holding by a user of said player of said magnetic movement gaming device.

4. The magnetic movement gaming device of claim 1 wherein said at least one traveling magnet supporting track means comprises a length of generally cylindrical malleable wire such that formation of curvilinear designs is facilitated.

5. The magnetic movement gaming device of claim 1 wherein said traveling magnet is generally cylindrical having a center longitudinal bore extending therethrough such that said traveling magnet is movably mounted on said at least one traveling magnet supporting track means with said at least one traveling magnet supporting track means extending through said center longitudinal bore.

6. The magnetic movement gaming device of claim 1 further comprising an elongate wand having an end on which said propulsion magnet is mounted thereby facilitating positioning of the propulsion magnet relative to traveling magnet in a more accurately controllable manner.

7. The magnetic movement gaming device of claim 6 wherein said at least one traveling magnet supporting track means comprises two traveling magnet supporting track means mounted on said base and extending upwards therefrom.

8. A magnetic movement gaming device comprising:

a base;

at least one curvilinear wire track extending upwards from said base;

a traveling magnet having a wire track engaging bore hole formed therein, said traveling magnet movably mounted on said at least one curvilinear wire track with said at least one curvilinear wire track extending through said wire track engaging bore hole;

a propulsion magnet generally freely movable about said traveling magnet; and said propulsion magnet operative to propel said traveling magnet along said at least one curvilinear wire track upon said propulsion magnet being moved generally adjacent said traveling magnet, said traveling magnet being moved along said at least one curvilinear wire track via magnetic force between said propulsion magnet and said traveling magnet.

9. The method of playing a magnetic movement game comprising the steps:

providing at least one longitudinally extended, generally curvilinear traveling magnet supporting track means, a traveling magnet having a north and south pole movably mounted and at least substantially surrounding said at least one traveling magnet supporting track means and a propulsion magnet having a north and south pole generally freely movable about said traveling magnet;

moving said propulsion magnet adjacent said traveling magnet;

interacting the magnetic fields of said traveling magnet and said propulsion magnet such that the like poles of said traveling magnet and said propulsion magnet produce a repulsive magnetic force therebetween thereby forcing said propulsion magnet and said traveling magnet away from one another;

preventing magnetically induced motion of said propulsion magnet such that said traveling magnet is magnetically driven away from said propulsion magnet along said at least one traveling magnet supporting track means; and continuing to move said propulsion magnet towards said traveling magnet such that said traveling magnet is pushed and moved via magnetic force along said at least one traveling magnet supporting track means towards a game-winning location along said at least one traveling magnet supporting track means.

10. The method of claim 9 wherein said steps of interacting, preventing and continuing each respectively alternatively comprise;

interacting the opposite poles of said traveling magnet and said propulsion magnet to produce an attractive magnetic force therebetween thereby pulling said propulsion magnet and said traveling magnet towards one another;

preventing magnetically induced motion of said propulsion magnet such that said traveling magnet is magnetically pulled towards said propulsion magnet along said at least traveling magnet supporting one track means; and continuing to move said propulsion magnet away from said traveling magnet such that said traveling magnet is pulled and moved via magnetic force along said at least one traveling magnet supporting track means towards a game-winning location along said at least one traveling magnet supporting track means.

* * * * *